United States Patent [19]

Brousseau

[11] Patent Number: 4,552,356

[45] Date of Patent: Nov. 12, 1985

[54] EXERCISE DEVICE

[76] Inventor: Francis J. Brousseau, 3052 Kingsbridge Ave., Bronx, N.Y. 10463

[21] Appl. No.: 628,912

[22] Filed: Jul. 9, 1984

[51] Int. Cl.[4] ..... A63B 21/02

[52] U.S. Cl. ..... 272/137; 272/126; 272/142; 272/143

[58] Field of Search ..... 272/137, 139, 126, 142, 272/143, 93, 96, 135, 136, 138, 140, 141

[56] References Cited

U.S. PATENT DOCUMENTS 1,706,654 3/1929 Christesen ..... 272/137
4,251,070 2/1981 Leseberg ..... 272/126

FOREIGN PATENT DOCUMENTS 4394 of 1912 United Kingdom ..... 272/137

*Primary Examiner*—Richard J. Apley
*Assistant Examiner*—Robert W. Bahr
*Attorney, Agent, or Firm*—Auslander & Thomas

[57] ABSTRACT

The invention features an exercising harness wherein the arms and legs are moved in unison providing a rhythmic exercising routine to be achieved. The harness comprises right and left hand grips, each having an inelastic leg strap attached thereto. An elastic cord is connected between the hand grips and allows a tension to develop between the movement of the limbs on either side with respect to the other side. In a typical routine, first the right arm and leg are raised, while the left arm and leg are held steady. The procedure is reversed, causing an alternating raising and lowering of limbs on each side. This provides a highly rhythmic exercise.

8 Claims, 3 Drawing Figures

EXERCISE DEVICE

This invention pertains to a physical fitness, hand and foot held exerciser device, and more particularly to an exercising harness wherein the arms and legs of the exerciser can be moved in unison within the confines of the restraints of the device.

There are numerous elastic-type exercise devices that provide for individual movement of the limbs of the user. Such exercising apparatuses do not provide for the development of a uniform exercising regimen, wherein the limbs can be coordinated in a unified manner.

The capability of moving the limbs in a rhythmic or coordinated fashion enables the exerciser to perform well-balanced exercise routines, as well as developing an isometric tension between the various muscle groups, i.e., chest arm, back and leg muscles are being used simultaneously and rapidly to maximum advantage.

Exercises wherein the arms and legs move in unison are known to be the most useful and effective in providing good health.

Therefor, there exists a need for an exercise apparatus that enables the user to coordinate the various muscles in a unified rhythmic routine.

The present invention seeks to fulfill this need by means of a unique harness device.

In U.S. Pat. No. 4,057,246 to Bradford W. Wilson issued Nov. 8, 1977, a multipurpose push-pull exerciser is illustrated. This exercising device features four resilient cords attached about a centrally located, rigid tube. Handle loops are disposed on each end of the resilient cords. Two of the resilient cords are meant to exercise the arms of the user, while the other two cords are meant to be rigidly held by the feet. While there are several ways in which the above device can be utilized, the resiliency of all of the cords does not provide any means wherein the arms and legs can be exercised in a unified manner.

A similar exercise apparatus is depicted in U.S. Pat. No. 4,033,580 to Irwin S. Paris, issued July 5, 1977.

This device is comprised of four elastic cords with handles disposed at the outer ends thereof. Each cord is joined to its adjacent cords, about an oblong junction portion disposed centrally about the cords.

Again, there is no teaching or suggestion how the subject exercise device can be used in an exercise routine that coordinates the arms and legs of the user in unison.

Other devices of the same general construction are also shown in U.S. Pat. Nos. 3,369,809 and 3,910,573. These apparatuses are also deficient of the advantages sought to be accomplished by the invention described herein.

The invention relates to an exercising harness for exercising the arms and legs in unison. The harness device comprises first and second means defining handle portions, and first and second members. The handle portion means are connected by means of an elastic cord member disposed between them. The leg attachment members each pass through a respective handle portion, i.e., the first leg attachment member passing through the first handle portion and the second leg attachment member passing through the second handle portion.

The leg attachment members are inelastic and comprise adjustable straps. The adjustment allows the straps to receive different leg lengths.

The handle portions and leg attachment members form loops in which the leg of the user is inserted.

The handle portions comprise substantially cylindrical hand grips that are flared on at least one end thereof.

The span of the elastic cord running between the handle portions has a length approximately between six to ten inches, corresponding to the distance between the outstretched legs of the exerciser.

In operation, an exerciser lying on his back, grips the handle portions, one in each hand, and inserts a corresponding leg into each strap loop of the leg attachment members. A right arm and leg or a left arm and leg must be raised in unison, due to the inelasticity of the harness straps. Tension between the right and left extremities is achieved by way of the elastic cord disposed between the handle grips.

As an arm and a leg are raised off the floor, both the force of gravity and the elastic force in the cord member act to restore these limbs to their original at rest position.

One exercise routine consists of raising first the right-side limbs while holding the left-side limbs rigid, and then reversing the process by raising the left-side limbs against the rigid right limbs.

It is an object of this invention to provide an improved exercising device.

It is another object of the invention to provide an exercise harness device that permits movement of both the arm and leg in unison.

Although such novel feature or features believed to be characteristic of the invention are pointed out in the claims, the invention and the manner in which it may be carried out may be further understood by reference to the description following and the accompanying drawings.

Referring now to the figures in greater detail, where like reference numbers denote like parts in the various figures.

Generally speaking, the invention features a device for exercising the arms, legs, chest and back of the user in order to achieve physical fitness. The device comprises an arm and foot constraining harness including inelastic leg straps that constrain the movement of the leg without also requiring movement of the corresponding arm. Both arm and leg are raised in unison against the restraining rigidity of the stationary side of the exerciser. Then, the process is reversed with the active side of the exerciser remaining stationary, while the formerly inactive side pulls against the harness. The resulting motion resembles a pull and pushing effect for alternating sides of the user.

In the following description, the same numerical designations are used throughout.

Figure 1:
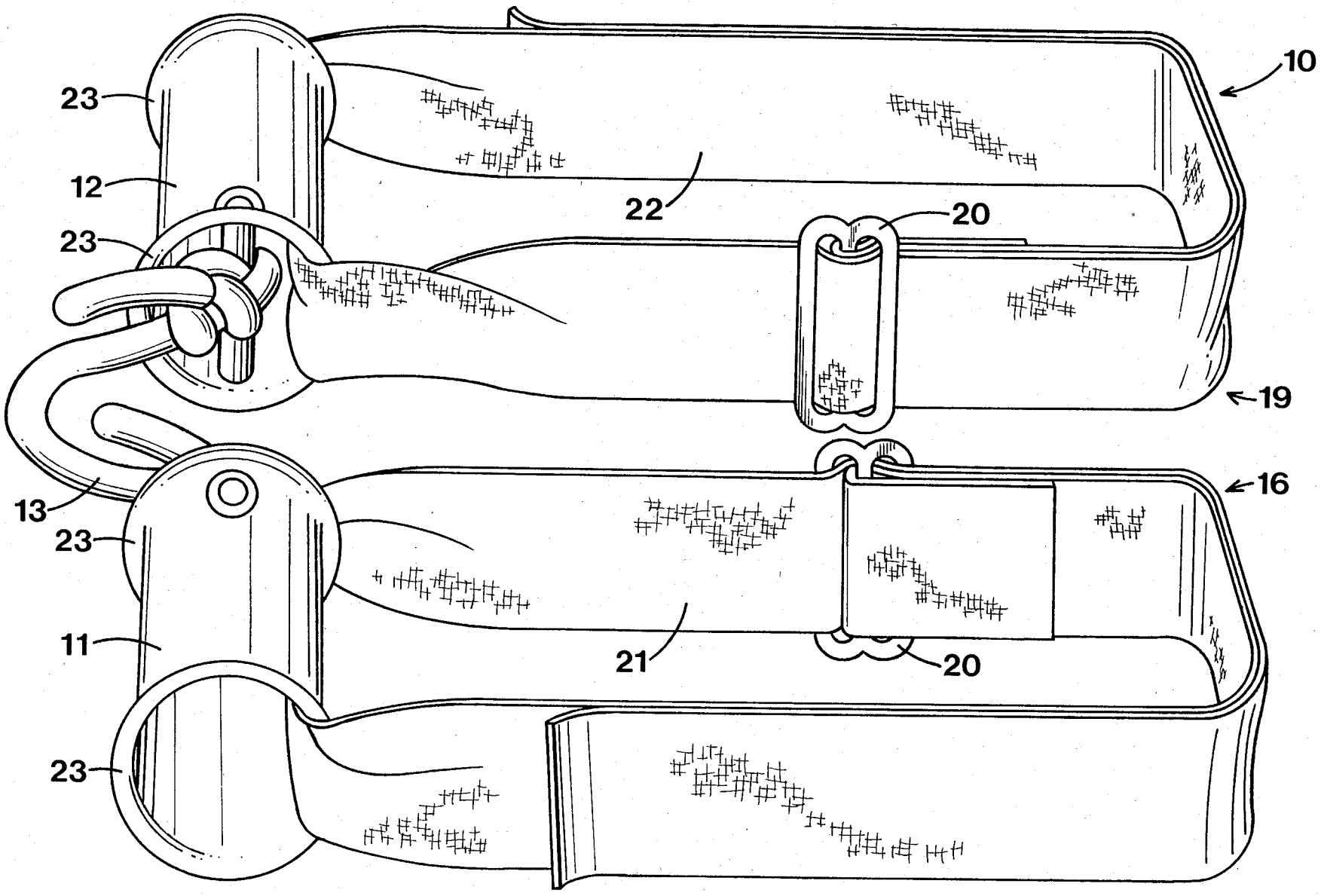
FIG. 1 is a perspective view of the exercise device of this invention.

Now referring to FIG. 1, the exercising harness 10 of this invention is illustrated. The harness 10 comprises a right-hand grip 11 connected to a left-hand grip 12 by a stretchable, elastic cord 13.

Figure 3:
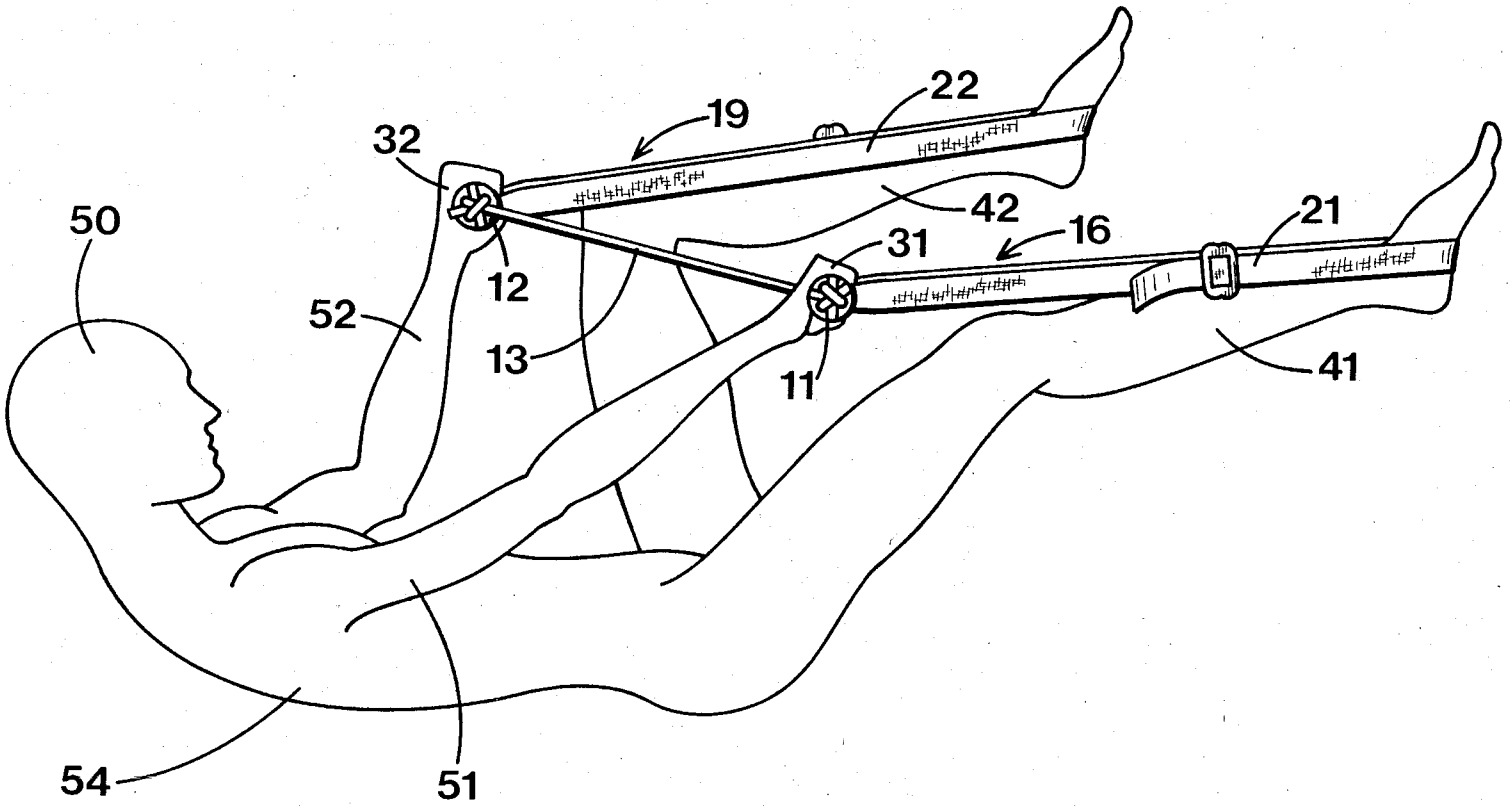
FIG. 3 is a side elevation view of the exerciser of FIG. 2 moving his left arm and leg in unison while utilizing the exercise device depicted in FIGS. 1 and 2.

A right leg strap 21 passes through the right-hand grip 11 thus, forming a loop 16 for the insertion of the right leg of an exerciser 50 of FIG. 3.

A left leg strap 22 passes through the left-hand grip 12 thus, forming a loop 19 for the insertion of the left leg of the exerciser 50 of FIG. 3.

The straps 21 and 22 are each adjustable to different leg lengths by means of adjustment buckles 20.

The straps 21 and 22 are inelastic and can be made from a woven nylon fabric similar to that used in automobile seat belts.

The elastic cord 13 can be made from rubber or bungee that provides a tensile force when stretched.

The hand grips 11 and 12 are each preferably cylindrical in shape, preferably with a flared rim 23 at least on one end. The rim 23 can be molded from plastic or formed from a metal blank. The grips 11 and 12 can be knurled to provide a friction surface to enhance the gripping thereof. The grips 11 and 12 may also be overcoated with a soft elastic material to provide a better grip.

Figure 2:
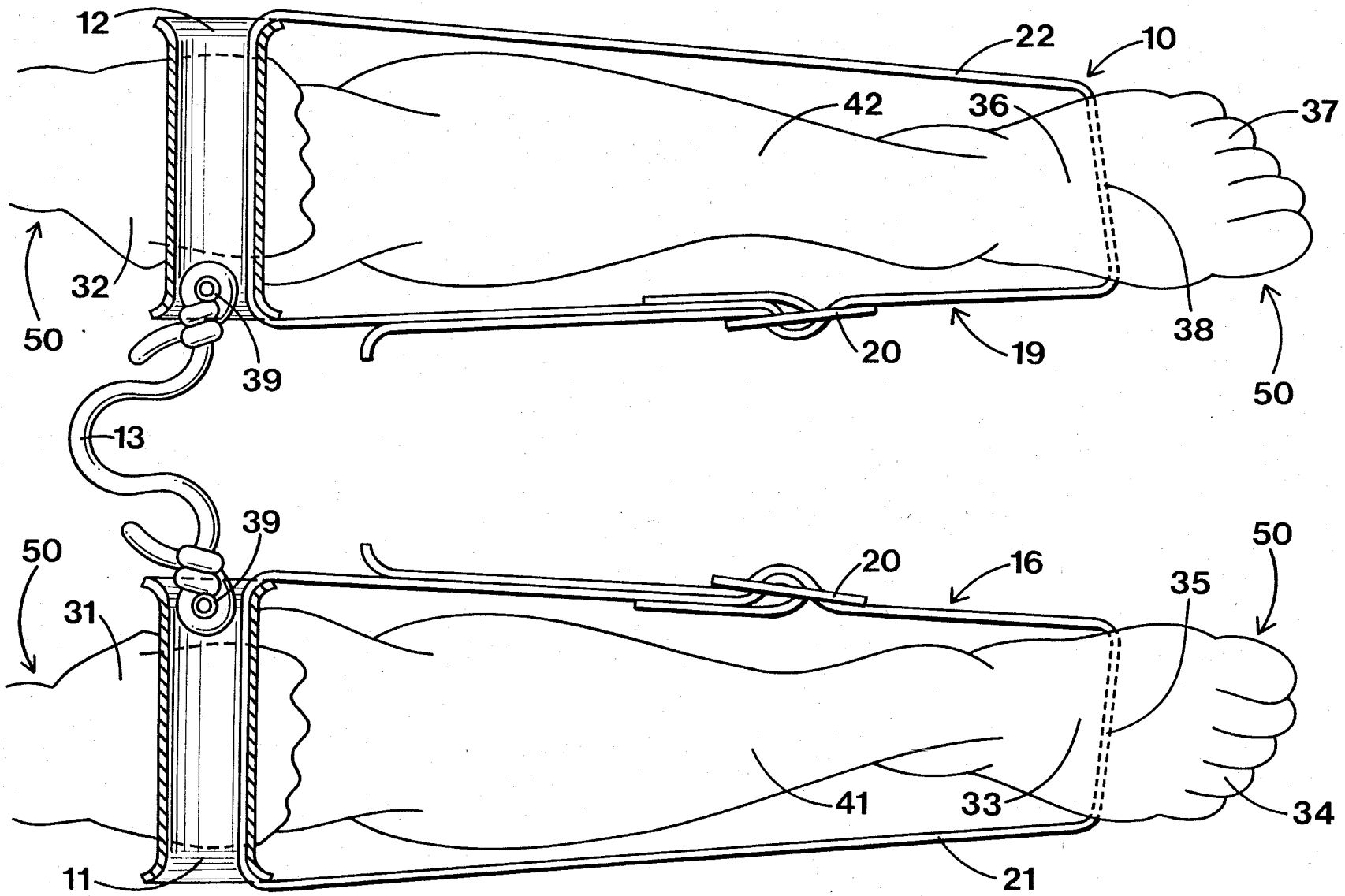
FIG. 2 is a plan view of the exercise device shown in FIG. 1, also depicting a partial view of the exerciser inserted in the leg attachments and gripping the handles of the device, while lying on his back.

Referring to FIG. 2, an exerciser 50 is shown disposed within harness 10 of FIG. 1. The exerciser will generally lie upon his back when getting into the harness and will exercise from this position as well, as will be described hereinafter.

The right hand 31 of the exerciser 50 will grip the right hand grip 11 as shown. Similarly, the left hand 32 shall grip the left-hand grip 12.

The right leg 41 of the exerciser 50 will be inserted within the right loop 16 of strap 21 by placing the arch 33 of the right foot 34 against the strap end 35 of loop 16.

Similarly, the left leg 42 of the exerciser 50 shall be inserted within the left loop 9 of strap 22 by placing the arch 36 of the left foot 37 against the strap end 38 of loop 19.

As aforementioned, the loops 16 and 19 can be adjusted to the length of each leg 41 and 42, respectively, by means of adjustment buckles 20.

In a preferred embodiment as set forth in FIG. 2, fixed pins 39 are preferably set within the hand grips 11, 12, so that the elastic cord 13 may be looped around the pins 39 and tied, as shown. It is preferable that the cord 13 have extra length so that in tying, it can be adjusted to the comfortable distance between the normal position of the hands 31 and 32 of the exerciser 50.

The exercise routines utilizing harness 10 are generally begun with the exerciser 50 lying on his or her back, the right hand 31 preferably directly above the right leg 41, and the left hand 32 preferably directly above the left leg 42, as depicted in FIG. 2.

One typical exercise routine using the harness 10 will be described with reference to FIG. 3. An exerciser 50, shown in FIG. 3, is lying on his back 54, with hands 31 and 32 gripping the right and left hand grips 11 and 12, respectively. Each leg 41 and 42 is placed in the loops 16 and 19, respectively.

The exerciser 50 first raises his left arm 52 and left leg 42, as shown, while holding the right arm 51 and right leg 41 steady. The left arm 52 and left leg 42 move in unison because the inelastic strap 22 is looped through the hand grip 12, thus forcing the leg 42 upwardly when the hand grip 12 is raised.

The exerciser 50 will feel two forces when these limbs are raised: (1) the force of gravity pulling downwardly on the limbs and (2) the elastic tension caused by the stretching of the elastic cord 13.

The exerciser 50 will have to push against the right grip 11 with arm 51 and hand 31, while the left arm 52 and leg 42 are raised.

After the left arm 52 and leg 42 are raised, the limbs are reversed, i.e., the right arm 51 and the right leg 41 are raised, while the left arm 52 and leg 42 are lowered and held steady. The right limbs will likewise feel the forces of gravity and the elastic tension of cord 13. Simultaneously, the left arm 52 and left hand 32 must push against grip 12. In pushing against the grips 11 or 12, the legs 41 and 42 may respectively assist the arms and hands.

The raising and lowering of first right and then left limbs provides an alternating rhythmic exercise, wherein both arms and legs pull and push in tension.

Because of the constraint imposed upon the arms and the legs by harness 10, first the right and then the left limbs will move in unison. Likewise, they will also push or hold steady in unison.

Other exercises are of course possible. The harness 10 of this invention will provide an exercise device wherein a rhythmic exercising of many muscles can be achieved in a facile manner.

The terms and expressions which are employed are used as terms of description; it is recognized, though that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. An exercising harness for exercising the arms and legs in unison, comprising first and second means defining handle portions, first and second inelastic leg attachment strap members each being attached directly to said first and second handle portions, said leg attachment strap members having means adapted to receive insertion of a leg of an exerciser, said inelastic leg attachment strap members further comprising means to adjust said strap to receive different leg lengths, and an elastic member disposed between said first and second handle portions and fixed to each said handle.

2. The exercising harness of claim 1, wherein said elastic member comprises an elastic cord.

3. The exercising harness of claim 1, wherein each of said first and second handle portions comprises a substantially cylindrical hand grip.

4. The exercising harness of claim 3, wherein each hand grip comprises a flared section on at least one end thereof.

5. The exercising harness of claim 1, wherein said straps are looped through their respective handle portion means.

6. The exercise harness of claim 2 wherein said elastic cord is of optional length.

7. The exercising harness of claim 2, wherein said elastic cord has a span of approximately between six and ten inches.

8. The exercise harness of claim 1 wherein said leg attachment members are loops.

* * * * *